United States Patent [19]

Matsushita et al.

[11] Patent Number: 4,684,275

[45] Date of Patent: Aug. 4, 1987

[54] ELECTRONIC TYPEWRITER WITH PRESETTABLE SPECIFICATION TABLES

[75] Inventors: Tsuyoshi Matsushita; Motoi Maekawa; Makoto Takahashi, all of Shizuoka, Japan

[73] Assignee: Tokyo Electric Co., Ltd., Tokyo, Japan

[21] Appl. No.: 508,065

[22] Filed: Jun. 24, 1983

[30] Foreign Application Priority Data

Feb. 22, 1983 [JP] Japan ..... 58-28224

[51] Int. Cl.[4] ..... B41J 5/08

[52] U.S. Cl. ..... 400/479; 400/70; 400/109; 400/484

[58] Field of Search ..... 400/70, 109, 110, 111, 400/479, 484; 200/5 E, 182, 186, 187, 188, 199, 200, 201, 202

[56] References Cited

U.S. PATENT DOCUMENTS

| | | | |
|---|---|---|---|
| 1,545,579 | 7/1925 | Bradley | 200/199 |
| 3,363,737 | 1/1968 | Wada et al. | 400/479 |
| 3,707,611 | 12/1972 | Twyford | 200/188 X |
| 3,820,644 | 6/1974 | Yeh | 400/110 |
| 3,950,734 | 4/1976 | Li | 400/110 X |
| 4,124,843 | 11/1978 | Bramson et al. | 400/109 X |
| 4,193,119 | 3/1980 | Arase et al. | 400/110 X |
| 4,217,055 | 8/1980 | Moon | 400/109 X |
| 4,289,411 | 9/1981 | Cornelius et al. | 400/111 X |
| 4,310,254 | 1/1982 | D'Angiolillo et al. | 400/109 |
| 4,342,210 | 8/1982 | Denningham | 20/5 E X |
| 4,353,653 | 10/1982 | Zimmerman | 400/110 X |
| 4,383,306 | 5/1983 | Morimoto et al. | 400/109 X |

FOREIGN PATENT DOCUMENTS

| | | | |
|---|---|---|---|
| 0088307 | 9/1983 | European Pat. Off. | 400/479 |
| 2627698 | 12/1977 | Fed. Rep. of Germany | 400/479 |

*Primary Examiner*—Ernest T. Wright, Jr.

*Attorney, Agent, or Firm*—Frishauf, Holtz, Goodman & Woodward

[57] ABSTRACT

An electronic typewriter includes a plurality of character keys, a specification selector, a printer circuit, and a memory for storing a plurality of specification tables, each having a plurality of key data. A data processing circuit detects a determined one of the plurality of specification tables in response to a selection signal from the specification selector, and reads out the corresponding key data from the specification table selected in accordance with the operation of the character keys, thereby driving the printer circuit in accordance with the key data. The specification selector includes a plurality of selection switches formed on the same keyboard together with the plurality of character keys.

6 Claims, 10 Drawing Figures

ELECTRONIC TYPEWRITER WITH PRESETTABLE SPECIFICATION TABLES

BACKGROUND OF THE INVENTION

This invention relates to an electronic typewriter.

In a conventional electronic typewriter as shown in FIG. 1, a keyboard 4 on which an array of keys for generating key signals for specifying characters and various required functions is arranged on the front of a housing 2. If a key on the keyboard 4 is operated, a key signal is generated and the printing operation is effected in accordance with the key signal.

FIG. 2 illustrates the details of the keyboard 4, which contains various character keys 6 and various function keys 8. However, the key characters, key functions and key locations of an electronic typewriter differ depending on the country where it is used; therefore, it is necessary to make the keyboard in compliance with the specifications of that country. Such a problem as differences in key characters, key functions and key locations can be eliminated by changing the printing characters of a print wheel (not shown) and the arrangement of the key tops. However, it is necessary to discriminate a specific function which is provided by a certain character key from ordinary inherent functions of the character keys. Such a specific function includes for example: the function by which, when a particular character key is operated, a carriage (not shown) is held at the present location after the corresponding character has been printed; or the function by which, when a certain character key is kept pressed for more than a predetermined time period, the corresponding character is repeatedly printed, or the like. To provide such a difference between these functions, the following methods have been considered. For example, (1) changing the internal connections between the keyboard 4 and an associated control unit (not shown); (2) changing the content of a read only memory (ROM) in the control unit; or (3) coupling a switching circuit (not shown) for selection of the specifications to the control unit, or the like. However, according to the methods (1) and (2), it is required that the wiring of the keyboard 4 be changed in compliance with the specifications of the keyboard 4 and that ROMs with different contents be used. The method (3) has an advantage over methods (1) and (2) since all of the contents corresponding to the various specifications are stored in a single ROM and the content of the ROM is selected in compliance with desired specifications using a switching circuit for the selection of the specifications.

As is schematically shown in FIG. 3, for example, this method (3) is obtained by coupling a switching circuit 10 for selection of the specifications to an additional input port of a control unit 12 whose input and output ports are connected to return lines RL and scan lines SL of a keyboard matrix circuit 14, respectively. However, to execute this method (3), it is necessary to couple the switching circuit 10 for selection of the specifications to the control unit 12. Hence, for example, in the case where the keyboard matrix circuit 14 and a control section including the control unit 12 and the switching circuit 10 are formed individually on separate printed circuit boards, it is impossible to use the keyboard matrix circuit 14 which is so constituted as to have a different specification from the specification selected by the switching circuit 10. In other words, it is impossible to commonly utilize the control unit 12 for the keyboard matrix circuits constituted to have different specifications. Thus, attention must be paid to the assembling process so that the control unit 12 is suitably combined with the keyboard matrix circuit having the same specification as the control unit 12.

Moreover, in the case where the operational section of the switching circuit 10 is disposed on the keyboard 4, particular countermeasures must be taken to deal with the increase in the number of connectors and the electric noise. Also, an additional input port must be provided for the control unit 12 to employ this switching circuit 10.

SUMMARY OF THE INVENTION

An object of the present invention is to provide an electronic typewriter which assures the easy selection of different specifications.

This object is accomplished by an electronic typewriter comprising a keyboard circuit having a plurality of character keys and selection switches; a printer circuit; a memory in which a plurality of specification tables, each including a plurality of key data, are stored; and a data processing circuit, coupled to the keyboard circuit, printer circuit and memory, to select any one of the plurality of specification tables in accordance with the operation of the selection switch and to read out the corresponding key data from the selected specification table in accordance with the operation of the character key, thereby driving the printer circuit in accordance with the key data read out.

In the present invention, the specification selecting switches together with the character keys are assembled in the keyboard circuit; therefore, it is possible to arrange the character keys in compliance with the specification of the electronic typewriter; and at the same time, to set the specification selecting switches to select one of the specifications. Namely, even in electronic typewriters with different specifications, the respective connections between the keyboard circuit and the data processing circuit are identical, resulting in a simple assembling process.

DETAILED DESCRIPTION OF THE PREFERRED EMBODIMENT

Figure 1:
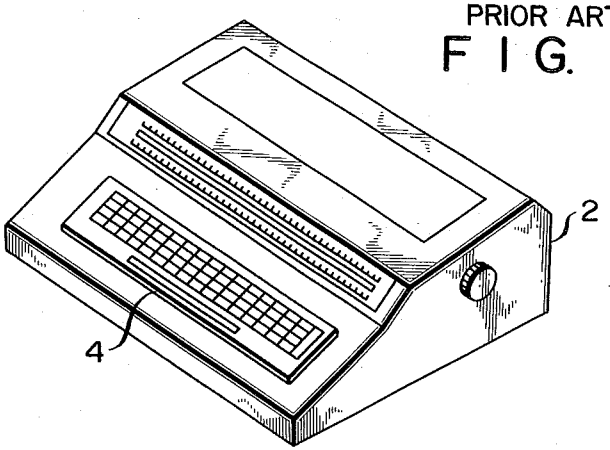
PRIOR ART FIG. 1
FIG. 1 is a schematic perspective view of a conventional electronic typewriter.
Figure 2:
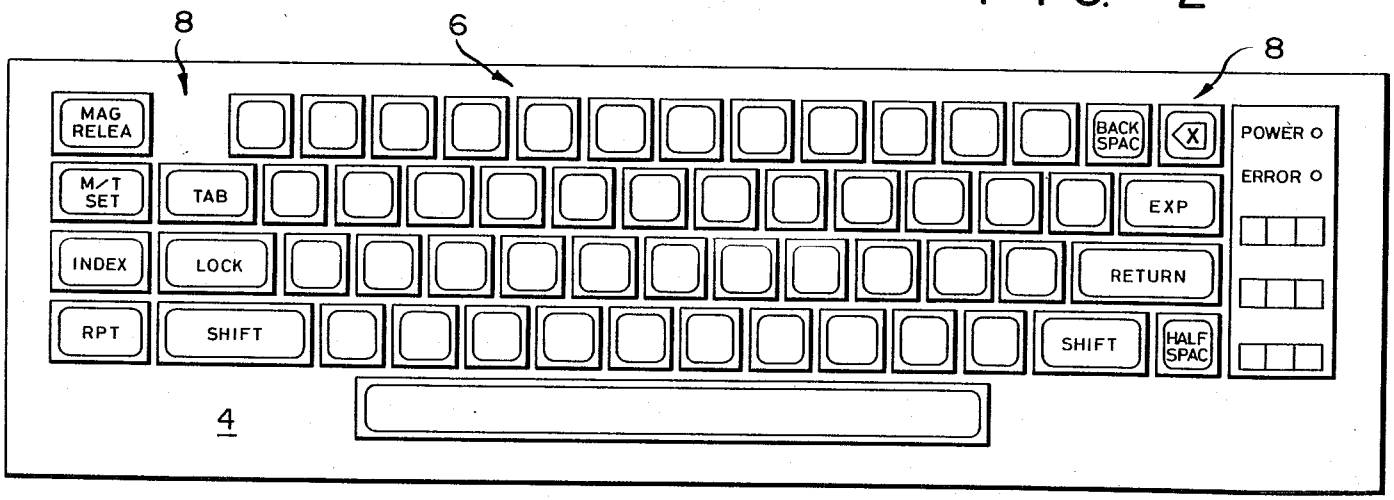
PRIOR ART FIG. 2
FIG. 2 is a detailed illustration of a keyboard of the electronic typewriter shown in FIG. 1.
Figure 3:
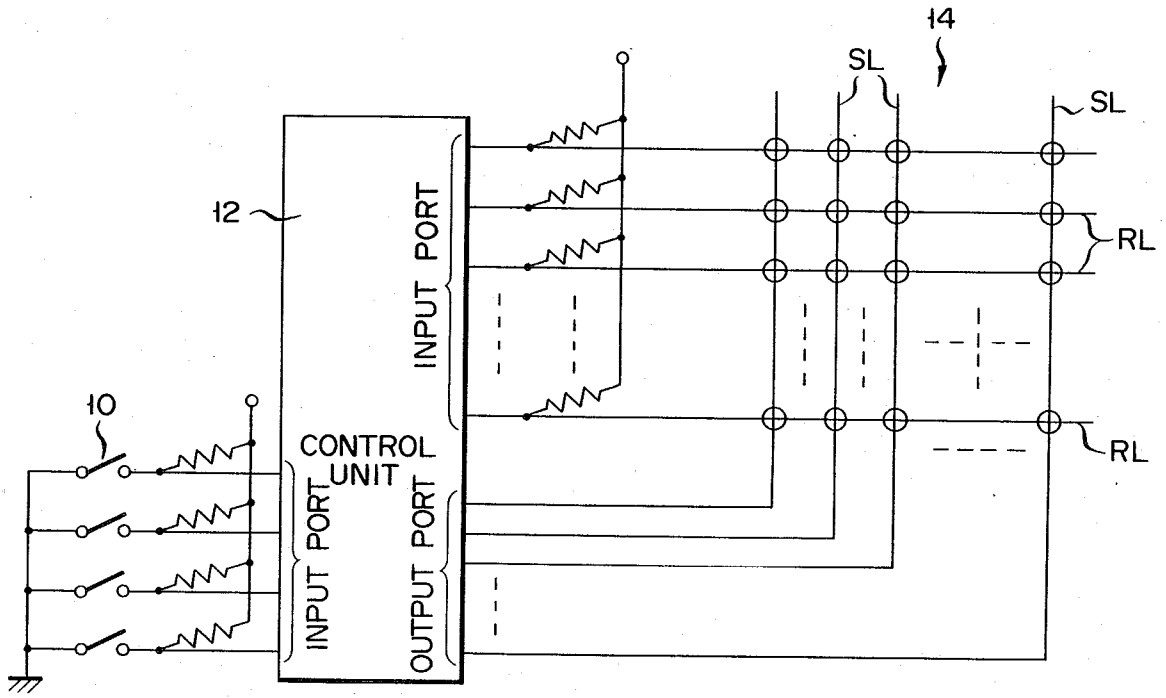
PRIOR ART FIG. 3
FIG. 3 shows schematic connections between a specification selection switching circuit, a keyboard matrix circuit and a control unit in a conventional electronic typewriter.
Figure 4:
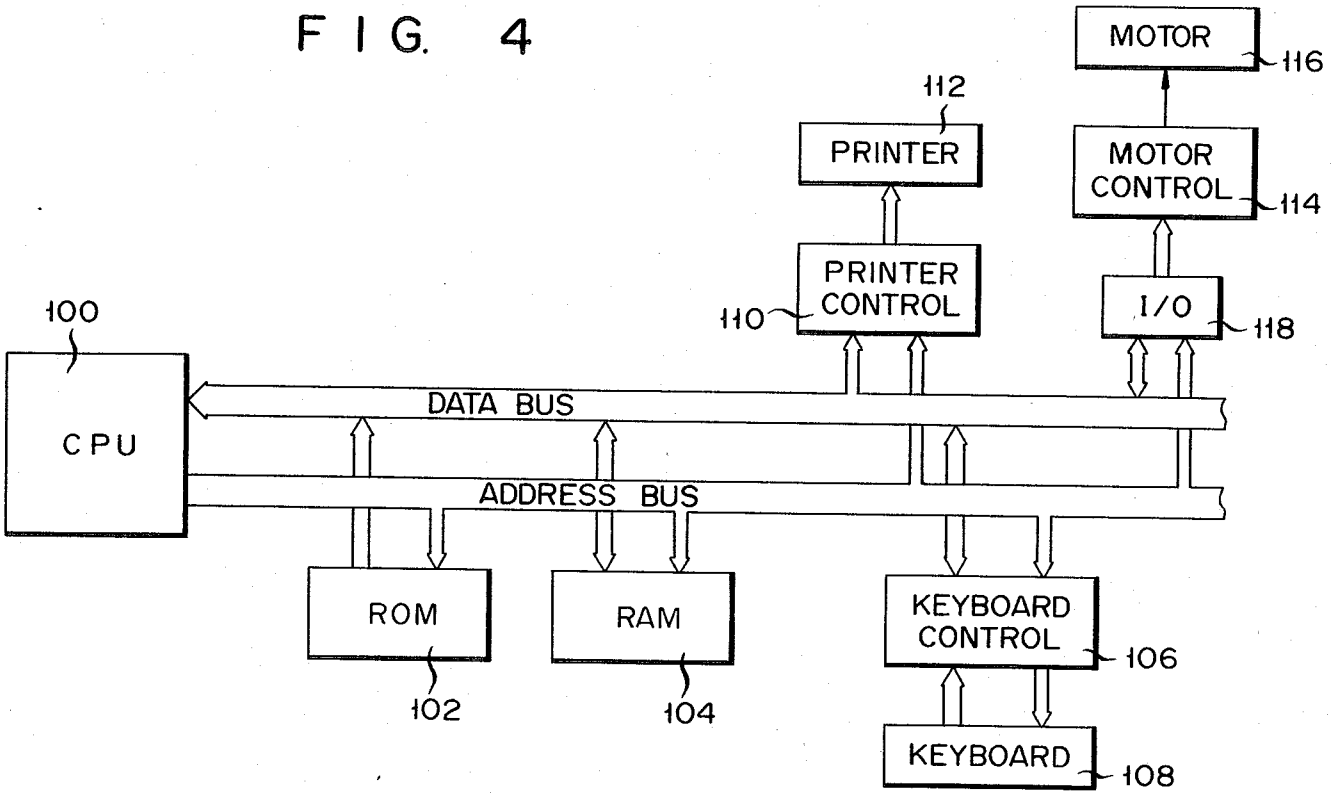
FIG. 4 is a block diagram of an electronic typewriter according an embodiment of the present invention.

FIG. 4 shows a block diagram of an electronic typewriter in an embodiment of the present invention. This electronic typewriter includes a central processing unit (CPU) 100, a read only memory (ROM) 102 and a random access memory (RAM) 104 which are connected to the CPU 100, a keyboard control 106 for transmitting key signals generated by a keyboard 108 to the CPU 100, a printer control 110 for driving a printer 112 in response to the print data from the CPU 100, and a motor control 114 for driving a motor 116 to feed a carriage (not shown) which supports a printer head (also not shown) in response to a feed signal to be sent from the CPU 100 through an I/O port 118. For example, the CPU 100, ROM 102, RAM 104, keyboard control 106, printer control 110, motor control 114, and I/O port 118 may be formed on a common printed circuit board as a control unit, and the keyboard 108 may be formed on another printed circuit board.

Figure 5:
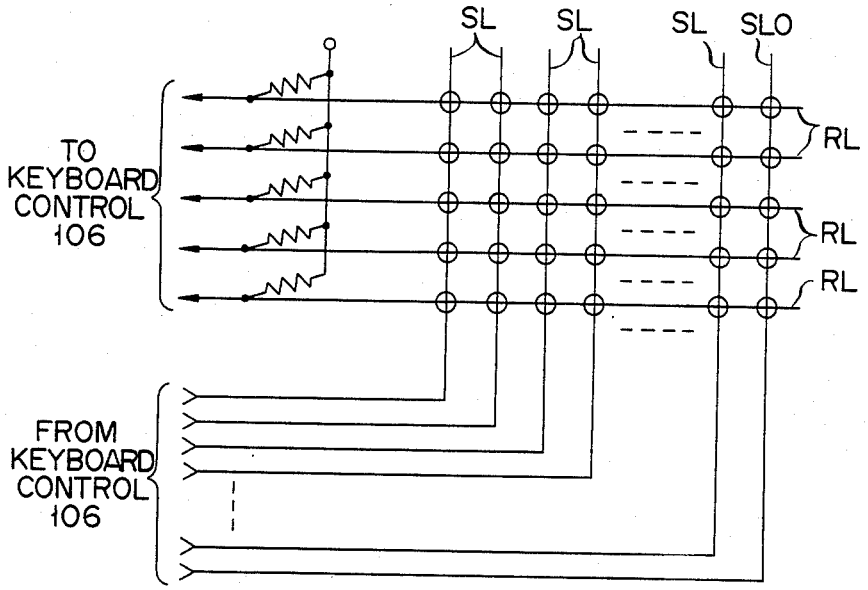
FIG. 5 shows a keyboard matrix circuit to be used in the electronic typewriter shown in FIG. 4.
Figure 6:
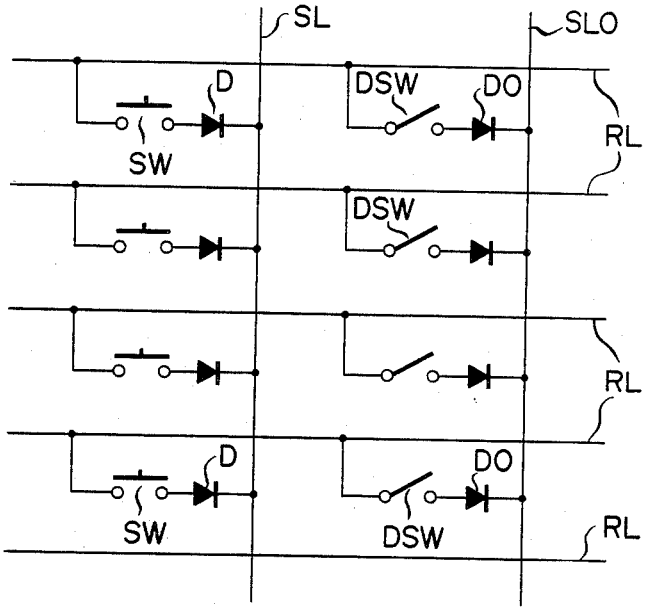
FIG. 6 shows a detailed construction of part of the keyboard matrix circuit shown in FIG. 5.

FIG. 5 shows a circuit diagram of the keyboard matrix corresponding to the keyboard control 106 shown in FIG. 4. This keyboard matrix circuit includes a plurality of scan lines SL and an additional scan line SLO which are connected to the output port of the keyboard control 106 and which are sequentially selected by selection signals from the CPU 100; and a plurality of return lines RL which are cross-coupled to these scan lines SL and SLO and connected to the input port of the keyboard control 106. Each cross section of the return lines RL and scan lines SL is constituted by a series circuit of a diode D and a switch SW connected between the return line RL and the scan line SL, for example, as shown in FIG. 6. The switches SW may be used as the character keys. Likewise, each cross section of the return lines RL and scan line SLO is constituted by a series circuit of a dip switch DSW and a diode DO connected between the return line RL and scan line SLO. The dip switches DSW are used for selection of the specifications.

Figure 7:
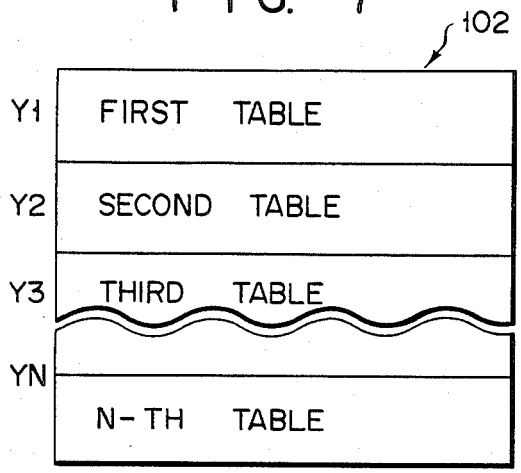
FIG. 7 shows a memory map of the ROM shown in FIG. 4.
Figure 8:
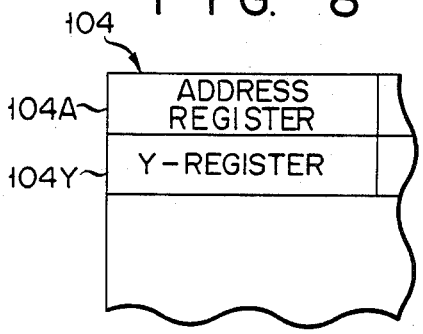
FIG. 8 shows a part of the memory map of the RAM shown in FIG. 4.

FIG. 7 shows a schematic drawing of the memory map of the ROM 102. The ROM 102 contains the first to N-th key-printing data conversion tables or specification tables. These tables correspond to, for instance, N kinds of specifications of electronic typewriters which are different in accordance with countries, and the specification tables have the head addresses Y1 to Yn, respectively. FIG. 8 shows part of the memory map of the RAM 104. The RAM 104 includes an input address register 104A for storing an input address signal corresponding to a key signal generated by operating a character key and a Y-registor 104Y for storing a head Y-address signal corresponding to a key signal generated by setting at least one dip switch DSW.

Figure 9:
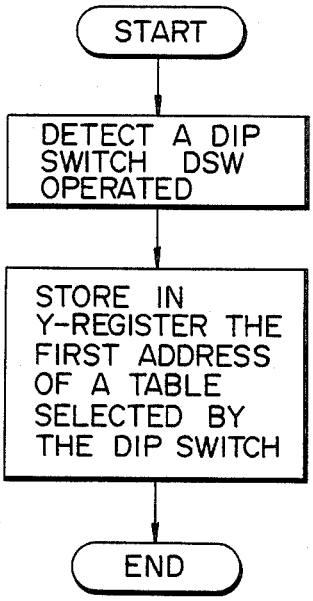
FIG. 9 shows a flowchart of the initialization process.

The CPU 100 first executes the initialization process shown in FIG. 9. Namely, the CPU 100 supplies a scan signal to the scan lines SLO through the keyboard control 106 and detects the operated dip switch DSW by reception of the scan signal through one of dip switches DSW, which has been operated, a corresponding one of return lines RL and the keyboard control 106. Then, the CPU 100 writes the head address Yi of one of the first to N-th tables selected by the operated dip switch DSW into the Y-register 104Y.

Figure 10:
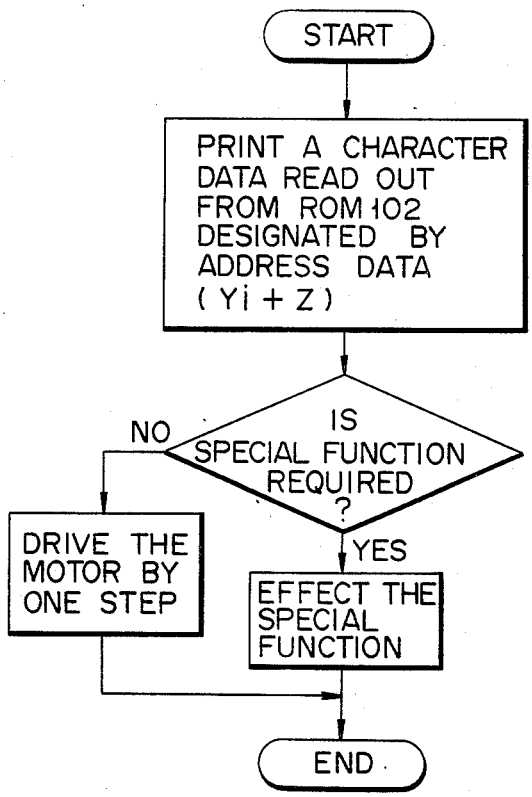
FIG. 10 shows a flowchart of the execution process.

Thereafter, the CPU 100 performs the execution process shown in FIG. 10. Namely, upon operation of one of switches SW, the operated switch SW is detected and the corresponding input address data Z is stored in the input address register 104A. Then, the input address data Z and Y-address data Yi are read out from the input address register 104A and Y-register 104Y, respectively, and added. An address of the ROM 102 is designated by the address data (Yi+Z). Thereafter, the CPU 100 supplies the print data read out from the designated address location in the ROM 102 to the printer control 110, and causes the printer 112 to print the selected character. Then, the operated switch SW is checked whether or not it is a special character key such as to require a special operation. If it is detected that the operated switch SW is not a special character key, a drive signal is supplied through the I/O port 118 to the motor control 114 to drive the motor 116 by one step, thereby moving a carriage (not shown) by only a predetermined distance. Thereafter, this execution process is completed. When it is detected that the operated switch SW is determined to be a special character key, the corresponding special function required is executed. Thereafter, the execution process is completed. For example, when the operated switch SW is the special character key which requires that the carriage is not moved after printing operaton, the execution process is finished without moving the carriage after printing operation. When the special key has been pressed to require that when the character key is kept depressed over a predetermined time period, the corresponding same character is printed repeatedly, the execution process is completed after the execution of this repeated printing operation.

In the above-described embodiment of the present invention, the key-printing data conversion tables which have been made in compliance with the arrangement pattern of a plurality of keys 6 on the keyboard 4 are assigned in the ROM 102, and one of the conversion tables is easily selected by operating one of dip switches DSW; therefore, even if the specification of the keyboard 4 is changed, the same type of control unit including the CPU 100, ROM 102, RAM 104, keyboard control 106, printer control 110, motor control 114 and I/O port 118 can be used. In other words, the specifications of an electronic typewriter can be changed by merely setting a predetermined dip switch DSW and changing the key tops on the same keyboard 4.

The present invention has been described with respect to one preferred embodiment; however, the present invention is not limited to only this embodiment. For example, a diode of a plug-in type may be substituted for the series circuit of the dip switch DSW and diode DO.

What is claimed is:

1. An electronic typewriter, comprising:

a printer circuit;

memory means for storing a plurality of specification tables, each having a plurality of key data and respectively corresponding to a plurality of key arrangements;

a keyboard circuit including a plurality of key operation scan lines, a plurality of return lines, an additional, key specification scan line, at least one selection diode which is connected between said additional scan line and a corresponding one of said plurality of return lines to select one of said plurality of specification tables, and a plurality of character keys which are arranged in accordance with one of said plurality of specification tables and each of which includes a key switch connected between one of said plurality of key operation scan lines and a corresponding one of said plurality of return lines; and a data processing circuit, coupled to said keyboard circuit, printer circuit and memory means, for detecting said selected specification table in accordance with a scan signal on one of said return lines which is connected to said at least one selection diode, and to read out the corresponding key data from said selected specification table in accordance with the operation of said character keys for driving said printer circuit in accordance with said key data read out.

2. An electronic typewriter according to claim 1, wherein said keyboard circuit comprises a matrix circuit in which said character keys are arranged in matrix form.

3. An electronic typewriter according to claim 2, wherein said memory means comprises a first memory for storing a plurality of specification tables, each having a different head address; and a second memory including a first address register for storing the address data corresponding to the operated character key and a second address register for storing the head address data corresponding to one of said return lines which is connected to said at least one selection diode.

4. An electronic typewriter according to claim 2, wherein said keyboard circuit and said data processing circuit are formed on separate printed circuit boards.

5. An electronic typewriter according to claim 1, wherein said memory means comprises a first memory for storing a plurality of specification tables, each having a different head address; and a second memory including a first address register for storing the address data corresponding to the operated character key and a second address register for storing the head address data corresponding to one of said return lines which is connected to said at least one selection diode.

6. An electronic typewriter according to claim 1, wherein said data processing circuit includes:

a first memory for storing input address data which is generated when one of said character keys is operated;

a second memory for storing a reference address data indicating a reference memory location in said selected one of said plurality of specification tables; and a data processing unit for supplying to said memory means an address which is obtained in accordance with address data in said first and second memories to read out key data from a designated memory location of said memory means.

* * * * *